United States Patent [19]

Teng

[11] 4,443,206

[45] Apr. 17, 1984

[54] WELL TOOL

[75] Inventor: Chuan C. Teng, Houston, Tex.

[73] Assignee: Dailey, Inc., Houston, Tex.

[21] Appl. No.: 346,169

[22] Filed: Feb. 5, 1982

[51] Int. Cl.[3] ..... E21B 17/07; F16D 3/06

[52] U.S. Cl. ..... 464/20; 175/322; 267/125

[58] Field of Search ..... 175/321, 322; 267/125, 267/137; 464/18, 20

[56] References Cited

U.S. PATENT DOCUMENTS

| | | | |
|---|---|---|---|
| 1,767,350 | 6/1930 | Crowell | 175/321 |
| 2,325,132 | 7/1943 | Haushalter et al. | 175/321 X |
| 2,570,577 | 10/1951 | Manion | 464/20 X |
| 2,795,398 | 6/1957 | Ragland | 464/20 |
| 3,230,740 | 1/1966 | Fox | 464/18 |
| 3,301,009 | 1/1967 | Coulter, Jr. | 175/321 X |
| 3,306,078 | 2/1967 | Hughes | 464/20 |
| 3,323,326 | 6/1967 | Vertson | 464/20 |
| 3,339,380 | 9/1967 | Fox | 464/20 |
| 3,345,832 | 10/1967 | Bottoms | 175/321 X |
| 3,383,126 | 5/1968 | Salvatori et al. | 175/321 X |
| 3,406,537 | 10/1968 | Falkner, Jr. | 464/20 |
| 3,858,669 | 1/1975 | Jeter | 175/322 |
| 3,884,051 | 5/1975 | Bottoms | 464/20 |
| 3,998,443 | 12/1976 | Webb | 267/125 |
| 4,162,619 | 7/1979 | Nixon, Jr. | 464/20 |
| 4,246,765 | 1/1981 | Zabcik | 464/20 |
| 4,257,245 | 3/1981 | Toelke et al. | 175/321 X |
| 4,270,620 | 6/1981 | Lawrence | 175/322 |

OTHER PUBLICATIONS

Security Shock Absorbers (Security), Dresser Industries, Inc., May 1, 1979.

*Primary Examiner*—Stuart S. Levy
*Assistant Examiner*—Daniel P. Stodola
*Attorney, Agent, or Firm*—Gunn, Lee & Jackson

[57] ABSTRACT

A well tool carried in a drill string for maintaining bottom hole contact while absorbing angular and axial shock forces of a rotating drill bit. The tool has an elongated body with pipe joint ends and includes a tubular mandrel rotationally and slideably mounted within a tubular barrel. A groove (preferably helical) and roller connection guides the mandrel from the barrel during drilling. Resilient shock absorbing members between metal guide rings are carried between stop elements on the mandrel and barrel. Shock forces are absorbed initially by the rotating/telescoping movements of the mandrel within the barrel. Excess shock forces are absorbed in the members acted on by the stop elements on further inward/outward movements of the mandrel rotating in the barrel. Unique cross-over rings (graphite-filled Teflon ®) cushion the resilient members from impacts of the metal guide rings.

10 Claims, 9 Drawing Figures

WELL TOOL

BACKGROUND OF THE INVENTION

1. Field of the Invention

This invention relates to well tools used in the rotary drilling of wellbores, and it more particularly relates to a drill bit bottom hole contact and shock absorber device.

2. Background of the Invention

In the drilling of a wellbore, a rotary drill bit is employed for cutting away the formations being penetrated. The drill bit is suspended upon a drill string which can be of great lengths, e.g. 25,000 feet. Although the drill bit rotates at relatively low RPM, it can generate relatively large shock forces of both angular and axial directiveness that are applied to the drill string. These shock forces can cause physical injury to both the drill string and drill bit. Also, these shock forces prevent maintaining the drill bit in contact with the bottom of the wellbore. As a result, the efficiency of drilling can suffer from even small axial displacements (e.g., one half inch) of the drill bit from contact with the formation being penetrated. Likewise, angular shocks produce serious variations in the torque applied to the drill bit which results in non uniform formation penetration. Obviously, it is most desirable to prevent the angular and axial shock forces from the drill bit being applied to the drill string or effecting the bottom hole contact by the drill bit.

Various well tools have been proposed to have either bottom hole contact function or shock absorber functions. A few well tools have been proposed to provide a combination of such functions. In general, these combination tools use a helical connection in the well tool and a fluid dash pot or hydraulic cushion. As a result, these combination tools are very complex in construction and element functioning which leads to short operational lives, difficult field servicing, repairs and other undesirable results.

The present invention provides a well tool combining in function the bottom hole contact and shock absorber features but with a relatively simple construction, long life in well drilling and a relatively simple constructable and repairable structure.

SUMMARY OF THE INVENTION

In accordance with this invention, there is provided a well tool for maintaining bottom hole contact while absorbing angularly and axially directed shock forces of a rotating drill bit carried on a drill string. The tool has an elongated body with connections for threaded assembly into a string of well pipe. A tubular mandrel rotationally and slideably mounted in a tubular barrel form the body. An annular chamber isolated from well fluid is defined between the mandrel and the barrel. Resilient shock absorbing members between metal guide rings are carried in the chamber between stop means. The mandrel carries a plurality of grooves, preferably left hand helical grooves, in which ride rollers carried by the barrel so that the mandrel is controlled angularly in movement while telescoping within the barrel. Crossover rings cushion the resilient members from rotary and axial impacts of the metal guide rings. The stop means with the resilient members limit the inward and outward telescoping movement of the mandrel in the barrel.

The shock forces across the body are initially absorbed by the inward and outward telescoping movement of the mandrel in the barrel and also by action of the rollers within the left hand helical grooves. Excess shock forces are absorbed by the stop means acting on the resilient members during further inward/outward movements of the mandrel in the barrel.

DESCRIPTION OF THE DRAWINGS

In the drawings, like parts will carry like numerals throughout the several views so as to simplify the description of the well tool employing the present invention.

DESCRIPTION OF PREFERRED EMBODIMENT

Figure 1:
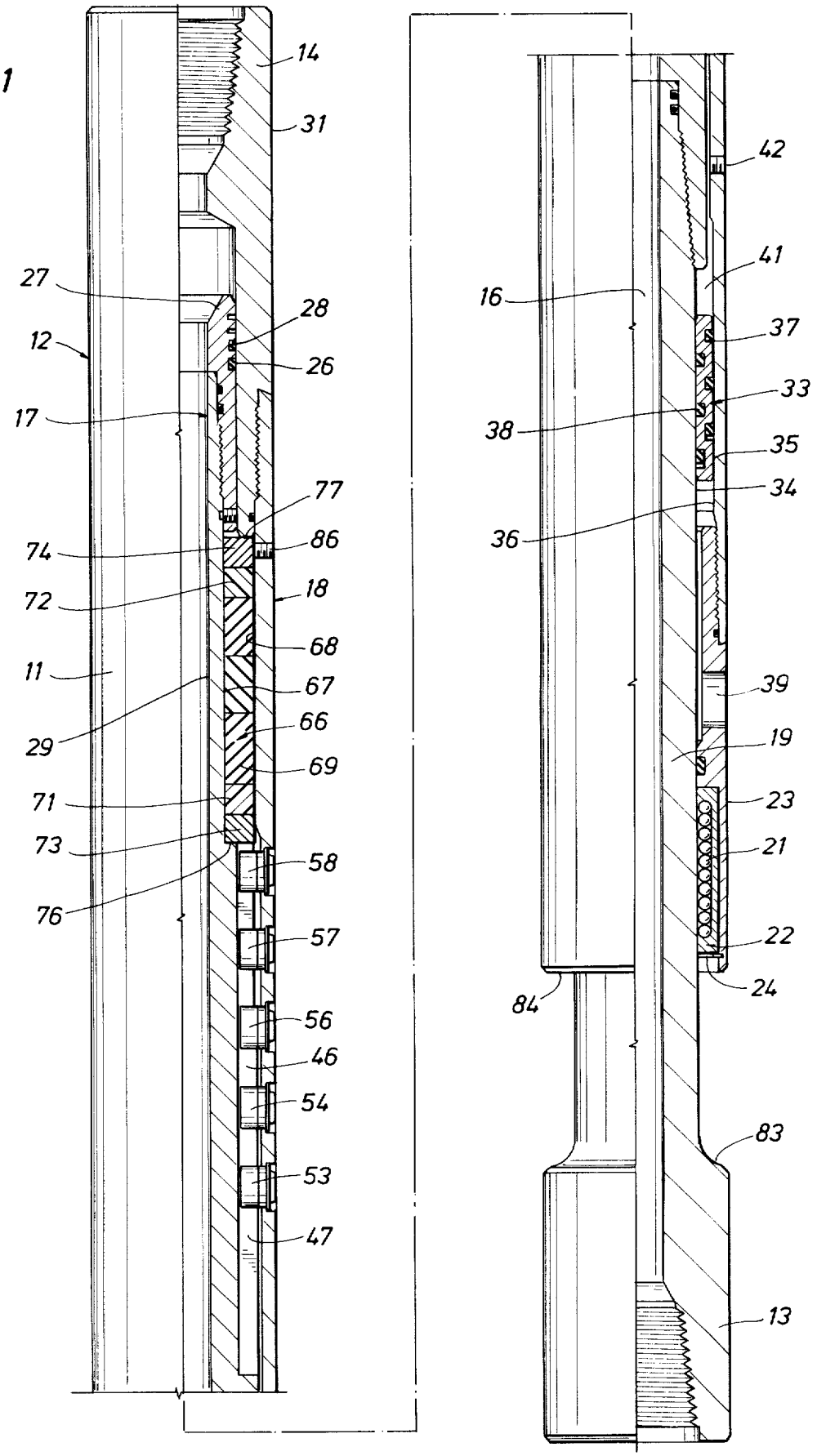
FIG. 1 is an elevation, partially in longitudinal section, of a preferred embodiment of the present well tool in closed position.

Referring to the drawings, there is shown a preferred embodiment of the well tool 11 of the present invention. The well tool 11 is usually placed into a string of drill pipe, preferably adjacent the drill collars and above the rotary drilling bit. The well tool is placed as close as convenient to the rotary bit so as to absorb the shock forces generated during drilling and also to insure the maintenance of the drill bit in contact with the formation being penetrated. The well tool 11 as can be seen in FIG. 1, is comprised of a body 12 which carries threaded connections as for example, boxes 13 and 14 for interconnection into a string of well pipe. Usually, the box 13 receives the rotary drill bit while the box 14 threads into the superimposed well pipe string. However, the boxes 13 and 14 may be arranged into a pin and box arrangement, if desired. The body 12 has an axial flow passage 16 which extends between its ends to accommodate flows of drilling fluid and the like.

More particularly, the body 12 is formed of a tubular mandrel 17 that is rotatably and slidably mounted within an exterior tubular barrel 18. For this purpose, the mandrel 17 in its lower section 19 is provided with a cylindrical bearing surface upon which is accommodated a linear roller bearing 21 mounted within a recess 22 in the lower section 23 of the barrel 18. The bearing 21 is secured in operative position within the recess 22 by a retainer nut 24. It is preferred to employ the linear bearings 21 for the rotary and sliding connection at the lower part of the well tool 11. The rotary and sliding interconnection may be provided at the upper part of the well tool by a cylindrical bearing surface 26 carried upon an upper section 27 of the mandrel 17. In addition, the upper section 27 may carry a plurality of fluid seals 28 which provide a leak proof rotary and sliding joint between the mandrel and the barrel. The upper section 27 is threadedly mounted upon the central section 29 of the mandrel 17. Similarly, the upper section 31 of the barrel 18 may be threadedly mounted upon to the center section 32 of the barrel 18.

The lower end of the body 12 carries a floating seal 33 which is slideably contained within an annular chamber defined by cylindrical wall surfaces 34 and 36 between the mandrel and barrel, respectively. More particularly, the seal 33 is formed of an annular metal sleeve 35 containing a plurality of interior and exterior grooves. Seal rings 37 and 38 in the grooves provide the dynamic sealing function between the seal sleeve 35 and the adjacent surfaces 34 and 36 of the mandrel and the barrel. The annulus below the seal 33 is exposed to well fluids through a lower port 39 that is formed in the lower section 23 of the barrel 18. The lower section 23 is threadedly connected to the center section 32 of the barrel, and on the lower section 19 is threadedly connected to the outer section 29 of the mandrel, for convenient assembly of the tool 11.

The seals 28 of the upper section 27 of the mandrel 17 and the floating seal 33 defined an annular chamber 41 which is isolated from the well fluids surrounding the well tool 11. Preferably, the chamber 41 is filled with an oil. The floating seal 33 functions to maintain the oil in the chamber 41 at substantially the same hydrostatic pressure as the well fluid which surrounds the well tool 11. As a result, the upper and lower seals upon the body 12 function at substantially no pressure differential which insures their long life in rotary and sliding movements between the mandrel 17 and the barrel 18. The chamber 41 may be filled with oil through a plug port 42 that is carried in the center section 32 of the barrel 18. With this arrangement of the seals and journal bearings, the mandrel 17 can have both rotational and telescoping movements relative to the barrel 18 while the chamber 41 maintains a substantial uniform volumetric capacity and remains at substantially the hydrostatic pressure of the well fluid which surrounds the well tool 11.

Figure 4:
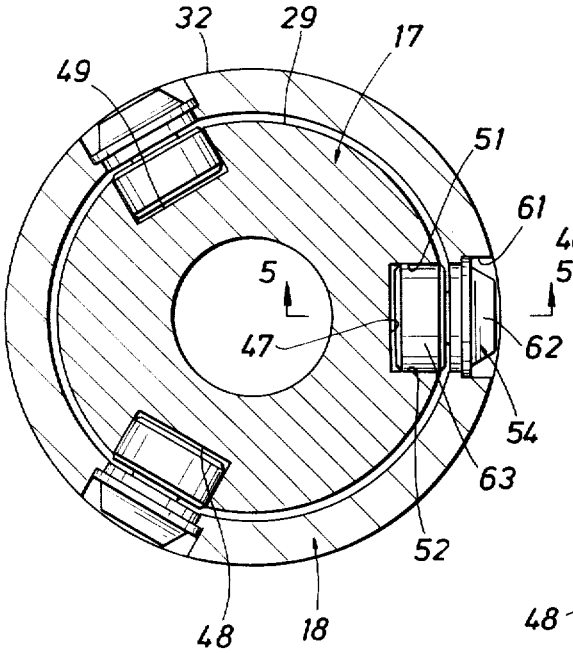
FIG. 4 is a crosssection taken along line 4—4 of the well tool shown in FIG. 3.
Figure 6A:
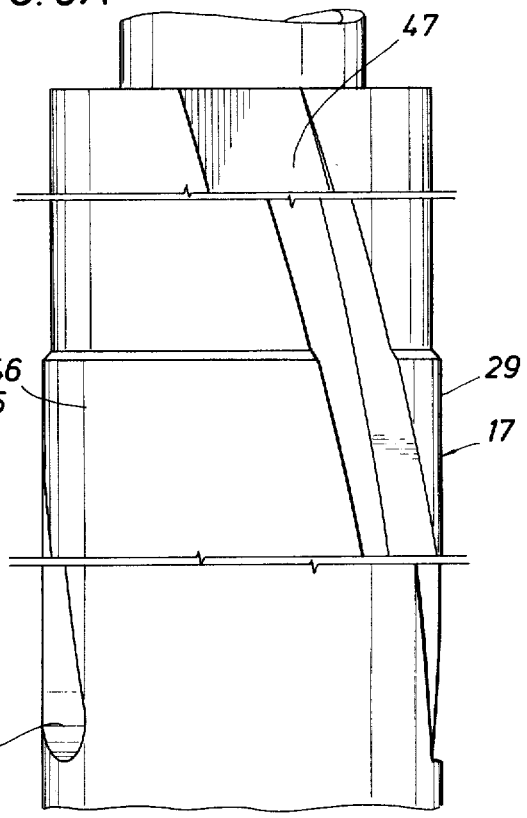
FIG. 6A is an enlarged partial elevation of the mandrel with left hand helical grooves as used in the present well tool.

The body 12 of the well tool carries a mechanism for maintaining the drill bit substantially in contact with the formation being penetrated during drilling operations. For this purpose, the center section 29 of the mandrel 17 carries a plurality of left hand helical grooves that extend longitudinally for some distance in its exterior surface. The region of these helical grooves is designated by the numeral 46. Referring momentarily to FIG. 6A, there is shown this portion of the mandrel 17 which contains these helical grooves. More particularly, a first helical groove 47 extends substantially the length of the region 46 and there can be seen a portion of a second helical groove 48. Preferably, there are an odd number of such grooves. For example, as seen in FIG. 4, the mandrel 17 may carry helical grooves 47, 48 and 49. These helical grooves preferably have a tangential flat bottom with sidewalls that are parallel to the diameter of the mandrel which passes centrally through the bottom of the groove. The helical groove 47 is shown with a flat bottom with sidewalls 51 and 52 parallel to the diameter which passes through the center of the mandrel 17 and the groove.

It will be apparent that the rotary drill bit is rotated in a right hand or counterclockwise direction as viewed downwardly through the well bore during the penetration of subterranian formations. Relative to this direction of bit rotation, the helical grooves are left handed in their configuration upon the mandrel. The pitch or lead characteristics of these helical grooves is relatively critical to the satisfactory operation of the present well tool 11. More particularly, the pitch is so arranged that its function in the present tool provides for urging the drill bit against the bottom of the well bore with a sufficient force to maintain its cutting efficiency, but without undersirably increasing the weight load upon the bit which insures proper penetration of the formation in which the well bore is being drilled. Good results have been obtained with the helical grooves having a lead of 15 degrees about the mandrel 17. Stated in a different manner, the helical grooves have a lead of approximately one turn in 60 inches along the length of the mandrel. However, it is to be understood that the length of the helical grooves along the mandrel is only a few inches. For example, the grooves may extend for only about 10 inches along the mandrel.

Figure 5:
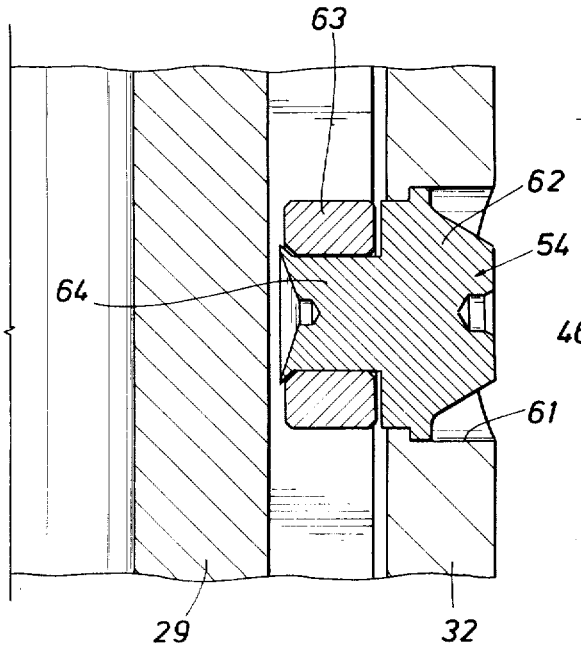
FIG. 5 is an enlarged section of the roller of FIG. 4 taken along line 5—5.

Referring to FIGS. 1, 4 and 5, the barrel 18 in the center section 32 carries in stepped openings a plurality of rollers which extend inwardly and drivably engage within each of the helical grooves. As a result, the mandrel 17 rotates within the barrel 18 during telescoping movements between these members. Preferably, there are several rollers in each of the grooves, such as the rollers 53, 54, 56, 57 and 58 within the helical groove 47. All the rollers have identical mountings in the barrel 18. Thus, only the rollers 54 will be described in detail. Referring to FIG. 4, the roller 54 is received within a stepped opening 61 formed within the center section 32 of the barrel. The roller 54 has a body 62 that is secured within the opening 61 by any convenient means, such as by a small welded bead at its peripheral edge within the opening 61. Extending radially inwardly from the body 62 is a roller bearing 63 which is carried on a bearing mount portion 64 of the body 62 as can be seen more clearly in FIG. 5. It will be apparent that the rollers 53–58 engage one of the side surfaces 51 or 52 of the groove 47. During normal drilling operations, the rollers ride upon the forward face 52 because of the right hand rotation of the well drill string. As a result, the mandrel 17 is urged downwardly by the left hand grooves from the barrel 18 so as to move the rotary bit into contact with the bottom of the borehole. Preferably, there are a like plurality of rollers carried in the barrel 18 within each of the grooves 47, 48 and 49. Thus, there is a like number, placement and symetry of the rollers to engage the several helical grooves in the mandrel 17. As a result, there is a uniform driving force transmitted between the barrel and the mandrel during rotary drilling operations.

It will be apparent that movement of the well drill string or the well bit relative to the bottom of the well bore, causes the mandrel 17 to telescope inwardly or outwardly within the barrel 18. This movement of the mandrel is a combination of both rotational and axial component displacement. Thus, the several rollers will ride up or down within the helical grooves depending upon the relative movements between the mandrel and the barrel. However, it is to be understood that because of the left hand configuration of the helical grooves, that the force of the rotating well drill string will always tend to urge the mandrel 17 outwardly from the barrel 18 and force the drill bit into contact with the bottom of the borehole.

The described arrangement of the helical grooves and rollers provide a rotary and telescoping movement relationship between the mandrel and the barrel. It will be apparent that the shock forces arising from the rotary drill bit, (or from other portions of the well drill string), are absorbed at least in part by the mandrel moving inwardly or outwardly and rotating within the barrel, through the action of the rollers riding within the helical grooves. For example, an upward or rearwardly directed shock force from the drill bit upon the mandrel pushes the mandrel upwardly within the barrel. Thus, the rollers now ride upon the rear side surface of the grooves so that their upward left hand movement is resisted by the rotational force directed by the right hand rotation of the barrel 18 relative to the mandrel 17. As a result, this shock force is dissipated by the reverse movement of the roller within the helical groove that is downwardly and against the forward face of each groove. The reversal in direction of these shock forces is also absorbed through the reverse action of the helical grooves and rollers. For example, a vibration which produces shock forces in a reversed direction, merely produces a reversal of the responses of the rollers in the helical grooves and these shock forces are likewise absorbed by the differential movement both rotationally and axially of the mandrel relative to the barrel of the well tool 11.

Figure 6B:
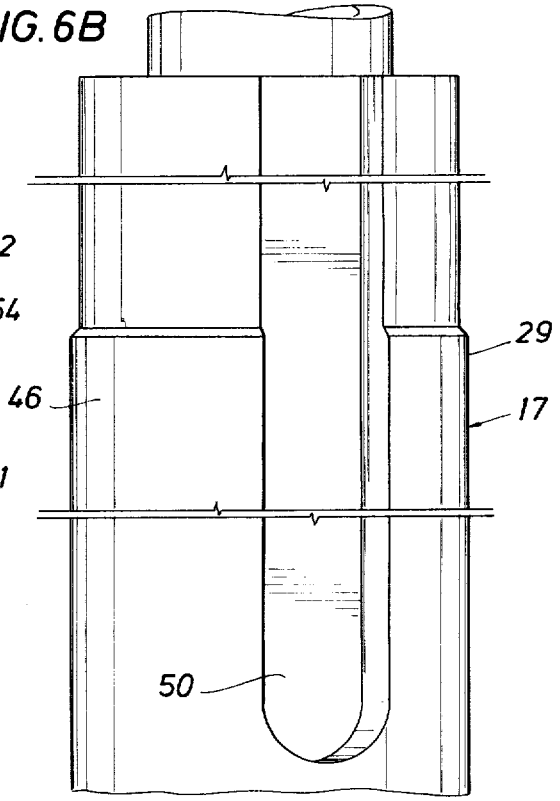
FIG. 6B is an enlarged partial elevation of the mandrel with straight grooves as used in the present well tool.

If desired, the mandrel 17 may carry a plurality of grooves that are arranged in other than a helical configuration. As seen in FIG. 6B, the mandrel carries a plurality of straight grooves 50, although only one of these grooves is shown. The grooves 50 are identical to the grooves 47–49 in both placement and function in the well tool except that they are straight in configuration on the mandrel 17. Naturally, the mandrel 17 with the straight grooves 50 in comparison to the helical grooves 47–49 will not exert as much force downwardly on the drill bit to force it into contact with the bottom of the borehole. Also, the straight grooves 50 do not absorb as much upward directed shock forces from the drill bit as do the helical grooves 47–49. However, the well tool with the mandrel 17 with straight grooves 50 can be used to good advantage in most drilling operations. Naturally, the rollers, to ride in each of the straight grooves 50, must also be straight in their placement within the barrell 18.

In addition, the well tool 11 carries a resilient shock absorber element 66 between the mandrel 17 and the barrel 18. The shock absorber element 66 functions both in the inward and outward movements of the mandrel 17 within the barrel 18 between definite longitudinal limits. Thus, the rollers can travel a predetermined distance within the helical grooves. However, the relative movements of the mandrel 17 to the barrel 18 will be brought in less than this predetermined distance to a stop by the action of the shock absorber element 66. Any arrangement may be employed for the shock absorber element 66 which can stop the telescoping inward and outward movement of the mandrel within the barrel 18 in a controlled manner without the abruptness of a metal-to-metal contact such as found in downhole jar tools employed in rotary drilling practices.

More particularly, the shock absorber element 66 can be a rubber sleeve contained within a chamber formed between the cylindrical sidewalls 67 and 68 of the opposing faces of the mandrel 17 and barrel 18. Preferably, the shock absorber element 66 is provided by a plurality of annular resilient members 69 which are arranged in a stack to substantially fill this chamber. At each end of the resilient member 69 are carried unique crossover rings 71 and 72, and metal guide rings 73 and 74 to complete the element 66.

More particularly, the resilient members 69 are constructed of any suitable shock absorbing medium, such as the natural or synthetic rubbers. The synthetic rubbers of the silicone variety provide good service in the present well tool where high downhole temperatures are encountered. However, the members 69 can be molded from the rubber material used in prior art shock absorber devices associated with the well drilling industry. The guide rings 73 and 74 are of a relatively hard metal and may be steel or brass. The function of these metal guide rings is in maintaining alignment of the crossover rings and resilient members 69 as the mandrel 17 telescopes inwardly and outwardly within the barrel 18. There may be times when the resilient member 69 and the associated crossover and guide rings are spread apart and then returned into engagement for absorbing axial and angular shock forces. Thus, the guide rings must maintain the alignment of the other associated components of the shock absorber element 66 during the inward and outward telescoping of the mandrel in the barrel.

The shock absorber elements 66 is arranged for functioning with the inward movement of the mandrel 17 within the barrel 18 by a stepped shoulder 76 that is formed within the center section 29 of the mandrel and a stepped shoulder 77 formed upon the end of the upper section 31 of the barrel 18. Thus, as the mandrel 17 telescopes inwardly within the barrel 18, the shoulders engage the metal guide rings and compress the resilient member 69 until the shock forces are absorbed therein. It will be recalled that the function of the rollers and helical grooves is to absorb a first portion of the shock forces. Thus, the resilient members 69 absorb the excess of such shock forces that are beyond the range of the forces absorbed through the action of the rollers and helical grooves. Since the mandrel undergoes substantial rotational and axial movement relative to barrel 18, it is preferred that the resilient members 69 have a relatively loose fit between the mandrel and the barrel. For example, the annular resilient members 69 may have a clearance between the wall surfaces 67 and 68 of 20 thousandths of an inch or greater. Thus, as the axial and angular shock forces are absorbed within the resilient members 69, they will be compressed and distorted outwardly during their functioning in the tool 11.

In addition, oil contained within the chamber 41 is trapped between the various elements forming the resilient element 66. This trapped oil tends to form a hydraulic cushion during the functioning of the shock absorber element 66. It will be apparent that large magnitude forces are involved in operation of the well tool 11. As a result, the components of the shock absorber element 66 will wear. This wearing of the resilient members 69 is significantly reduced by the unique crossover rings 71 and 72 that are employed in the element 66. More particularly, the crossover rings are formed of a particular bearing material that has a compressive yield between the compressive yield of the resilient members 69 and the compressive yield of the metal guide rings 74 and 73. For this purpose, it is preferably to form the crossover rings from a polymeric material, preferably of the reinforced variety, such as graphite filled Teflon. A ring constructed of this material may have a rectangular cross section to serve as a rotary bearing and also exhibits yielding properties which protect the resilient members 69 from being frayed or otherwise injured by impacts in both the angular and axial directions from the metal guide rings during compression of the shock absorber element 66. In addition, these crossover rings expand on compression to provide a fluid seal between the wall 67 and 68 so as to restrain the movement of oil trapped in the resilient element 66 from escaping freely past the guide rings and into the annulus 41. Thus, the resilient members 69 provide a shock absorber element 66 which also includes the hydraulic cushioning effects provided by the fluid sealing ability of the crossover rings 71 and 72.

Figure 2:
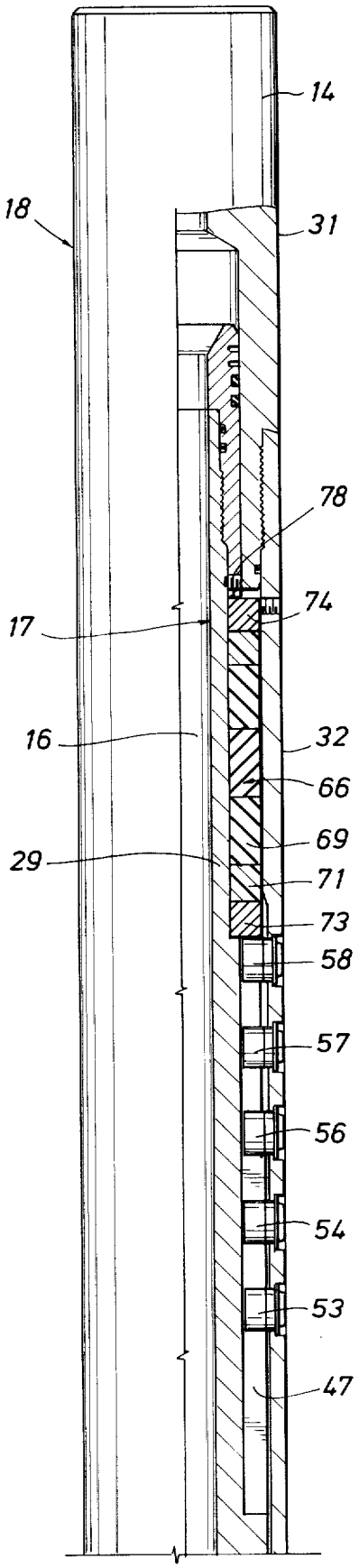
FIG. 2 is a partial elevation and longitudinal section of the well tool in open position.

The well tool 11 is shown in FIG. 1 in its inward or closed condition where the resilient element 66 is engaged between the shoulders 76 and 77 of the mandrel and barrel, respectively. Referring to FIG. 2, the tool 11 is shown in the open or ourward condition where the resilient element 66 is forced into a compressive state by engagement with a shoulder 78 carried upon the upper section 27 of the mandrel 17, and the roller 58 carried upon the center section 32 of the mandrel 18. The resilient element 66 functions in the same manner in the open tool condition of FIG. 2 as it did in the closed position shown in FIG. 1.

Figure 3:
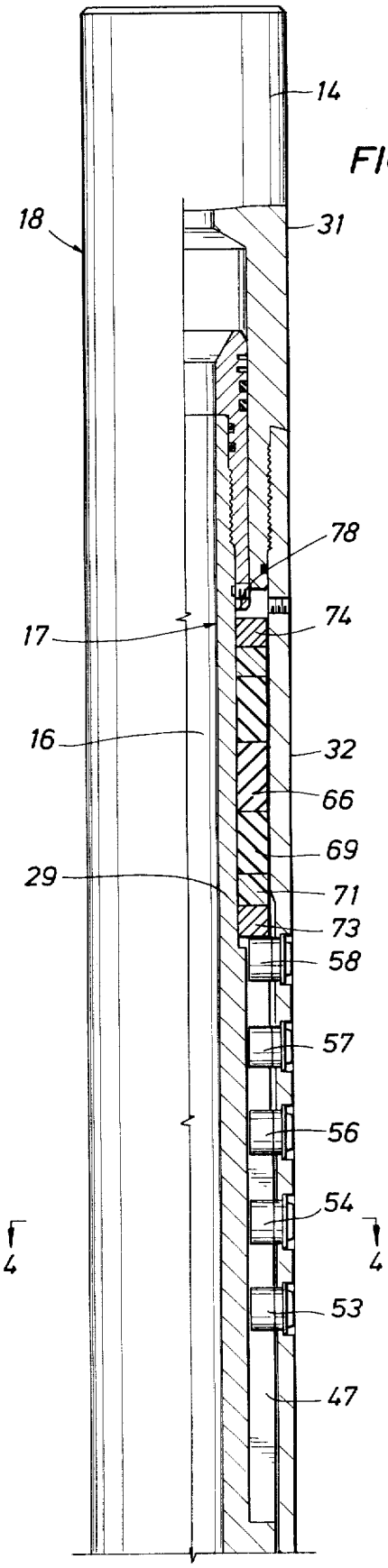
FIG. 3 is a view like FIG. 2 but illustrating the opened well tool with worn resilient shock absorber members.

Referring to FIG. 3, the open tool condition is shown substantially as it appears in FIG. 2 but where the resilient members 69 have been worn in their axial and radial dimensions through successive absorptions of the shock forces acting upon the tool. Thus, the stack dimension between the metal guide rings 73 and 74 is considerably shortened from that stack dimension shown in FIG. 2. However, the tool will operate in the same manner by the compression forces exerted by the shoulder 78 acting with the roller 58 in compressing the resilient members 69 into their shock absorbing state. Naturally, when the tool as shown in FIG. 3 is in the closed position, the resilient member 69 will first be slightly separated by the telescoping inward motion of the mandrel 17 until they are compressed through the action of the shoulders 76 and 77 on the mandrel and barrel, respectively.

It will be apparent that in the preceeding description the shoulders 76 and 77 provide one set of positive mechanical stops for energizing the resilient element 66 while the shoulder 78 in cooperation with the roller 58 provides a second mechanical stop when the mandrel 17 is telescoped inwardly and outwardly of the barrel 18.

Figure 7:
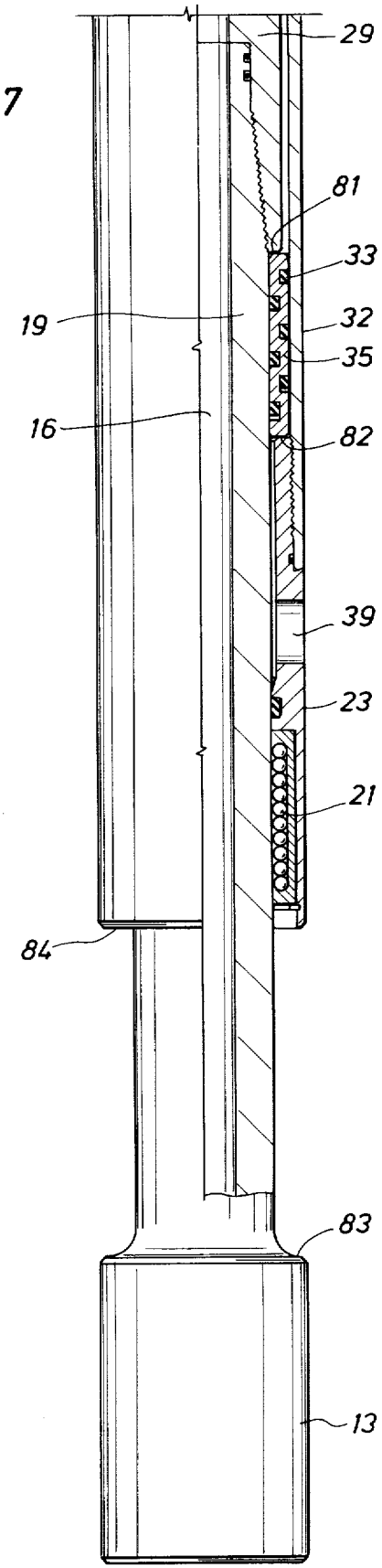
FIGS. 7 and 8 illustrate the ultimate metal-to-metal stops provided in the totally opens and closed well tool.

If the well tool 11 is operated for a sufficiently long period of time in rotary drilling operations, it will be apparent that the resilient members 69 will be worn very substantially in their axial and radial dimensions. Ultimately, the stack of these members 69 between the crossover and guide rings will be so shortened that their shock absorbing function is substantially eliminated from the well tool 11. However, the tool 11 cannot suffer damage when the resilient shock absorber element 66 ceases to function. More particularly, in reference to FIG. 7, when the tool 11 is in the totally open condition with the mandrel extended fully from the barrel 18, a metal-to-metal positive stop is provided by a shoulder 81 formed upon the center section 29 of the mandrel 17 where it is threadedly interconnected to the lower section 19. The shoulder 81 seats against the floating annular seal sleeve 35 which in turn is seated upon a shoulder 82 formed at the threaded connection of the lower section 23 of the barrel 18 to its connection to the center section 32. Thus, there is a metal-to-metal positive limit to the opening fully of the tool even if the shock absorber element 66 is totally inoperative.

Figure 8:
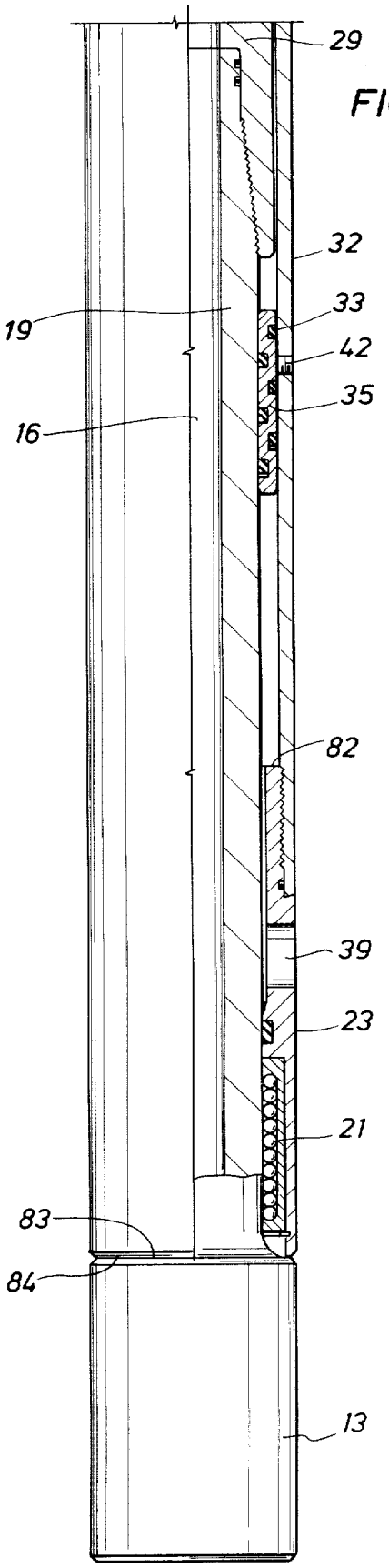

Similarly, in reference to FIG. 8, there is a positive metal-to-metal mechanical stop provided the tool in its fully closed condition if the resilient element 66 should totally fail. For this purpose, the lower section 19 of the mandrel 17 carries adjacent the box 13 of a radial extending shoulder 83 which is placed into abutment with the end 84 carried on the lower section 23 of the mandrel. Thus, when the tool is placed in its fully closed condition with the mandrel telescoped into the barrel 18, the metal-to-metal contact between the shoulders 83 and 84 prevents any injury to the well tool 11. However, it will be apparent in reference to FIGS. 7 and 8, that the functioning and shock absorbing of the rollers within the helical grooves, as the mandrel rotates and telescopes within the barrel 18 is yet effective. Thus, even if the resilient member 69 should fail, there is yet some level of shock absorbing function remaining in the well tool 11. Thus, it may be stated that the well tool 11 is failsafe in that it can perform yet some shock absorbing function even though the resilient element 66 should become ineffective through extreme wear or injury conditions to it.

The well tool 11 is assembled in a conventional fashion through the threaded interconnection through the several sections of the mandrel 17 and barrel 18. If desired, the chamber 41 is preferably filled through the plugged filling port 42 with the tool in a horizontal position. If desired, the air trapped within the chamber 41 may be vented through an auxiliary or air vent plugged port 86 which is provided adjacent the upper section 31 of the mandrel 18. Other assembling and filling techniques of the tool may be employed, if desired.

The well tool 11 is well suited for providing a combined function of insuring bottom hole contact of a rotary drill bit with the formation being penetrated while absorbing the angular and axial shock forces generated by the rotating drill bit, or the other components of the well drill string which contain the present tool. It will be apparent that the helical grooves and rollers provide a dual functioning in absorbing shock forces while insuring the maintaining the drill bit in contact with the formation being penetrated. In addition, shock forces in excess of those accommodated by the helical grooves and rollers are absorbed in a resilient sleeve or element contained between positive mechanical stops carried on the mandrel and barrel of the tool, and the resilient element is effective in both inward and outward telescoping functions. In addition, this bi-directional functioning of the shock absorber element in the present well tool continues until the resilient members are substantially worn or injured to the point of ceasing to operate. Even in this instance the tool through the action of the rollers and helical grooves can yet continue to absorb the shock forces applied across the tool.

From the foregoing, it will be apparent that there has been provided a novel well tool for maintaining bottom hole contact while absorbing angularly and axially directed shock forces of a rotating drill bit carried upon a drill string during the boring of well bores into the earth. It will be appreciated that certain changes or alterations in the present well tool may be made without departing from the spirit of this invention. These changes are contemplated by and are within the scope of the appended claims which define this invention. Additionally, the present description is intended to be taken as an illustration of this invention.

What is claimed is:

1. A well tool for maintaining bottom hole contact while absorbing angularly and axially directed shock forces of a rotating drill bit carried on a drill string comprising;

(a) an elongated body having threaded connections at its ends for assembly into a string of well pipe carrying a drill bit, said body having an axial flow passageway;

(b) said body formed of a tubular mandrel slideably mounted within a tubular barrel with an annulus exposed to well fluid between said mandrel and said barrel;

(c) fluid seals positioned in the annulus between said mandrel and said barrel forming an annular region isolated from well fluid;

(d) said mandrel and said barrel having shoulders at the ends of recessed opposite facing sidewalls defining a cylindrical chamber in the fluid isolated annular region;

(e) bearing means for providing telescoping and rotational movements of said mandrel in said barrel;

(f) a plurality of grooves extending longitudinally on said mandrel;

(g) rollers carried by said barrel and driveably engaged within said grooves to enable said mandrel to rotate relative to said barrel upon telescoping movements therein;

(h) a plurality of rings stacked in said cylindrical chamber between said shoulders;

(i) wherein cylindrical metal guide rings are included at each end of the stack of rings, said metal guide rings having a specified hardness;

(j) captured resilient shock absorbing ring means comprising said stack of rings between said metal guide rings, said ring means being formed of a resilient material to absorb shock and being less hard than said metal rings;

(k) cylindrical crossover rings interposed between and adjacent said guide ring and said rings means, and said crossover rings providing a fluid seal between said mandrel and said barrel, said crossover rings being formed of a material less hard than said guide rings and harder than said ring means to provide transitional yielding cushion and rotary bearing between said metal guide rings and said ring means when axially loaded within said chamber; and stop means for limiting by said members the inward and outward telescoping movement of said mandrel in said barrel during right hand rotation of the drill string which promotes outward movement of said mandrel in said barrel whereby shock forces across said body are initially absorbed by the inward and outward telescoping movement of said mandrel in said barrel along said grooves and the excess shock forces are absorbed by the stack of said members within said cylindrical chamber on further inward/outward movement of said mandrel within said barrel.

2. The well tool of claim 1 wherein said cylindrical chamber is oil filled and said grooves are in a left hand helical configuration.

3. The well tool of claim 2 wherein the plurality of rings being cooperative with a fluid floating seal between said mandrel and said barrel to maintain the hydrostatic pressure in the well bore in said cylindrical chamber.

4. The well tool of claim 1 wherein said stop means is a positive mechanical stop of said rollers within said grooves.

5. The well tool of claim 4 wherein said positive mechanical stop is one of said guide rings.

6. The well tool of claim 1 wherein said crossover rings are graphite filled polymer having a compressive yield between the compressive yields of said metal guide rings and said ring means.

7. The well tool of claim 1 wherein said grooves are rectangular in cross section with flat shoulders parallel to the diameter of the tubular member intersecting said grooves, and said rollers have flat peripheries engaging said flat shoulders.

8. The well tool of claim 1 wherein said guide rings are brass, and said mandrel and barrel are of steel.

9. The well tool of claim 1 wherein said stop means includes a mechanical means for stopping movement of said rollers within said grooves during inward movement of said mandrel in said housing upon said resilient shock absorber members suffering wear above a predetermined amount.

10. The well tool of claim 1 wherein said stop means comprises a first positive mechanical stop including one of said guide rings on movement of said rollers within said grooves during outward movement of said mandrel and a second positive mechanical stop to movement of said rollers within said grooves during inward movement of said mandrel.

* * * * *